US008485265B2

(12) United States Patent
Marya et al.

(10) Patent No.: US 8,485,265 B2
(45) **Date of Patent: *Jul. 16, 2013**

(54) SMART ACTUATION MATERIALS TRIGGERED BY DEGRADATION IN OILFIELD ENVIRONMENTS AND METHODS OF USE

(75) Inventors: Manuel Marya, Pearland, TX (US); Rashmi Bhavsar, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 829 days.

This patent is subject to a terminal disclaimer.

(21) Appl. No.: 11/769,207

(22) Filed: Jun. 27, 2007

(65) Prior Publication Data

US 2008/0149345 A1 Jun. 26, 2008

Related U.S. Application Data

(60) Provisional application No. 60/870,859, filed on Dec. 20, 2006.

(51) Int. Cl.
*E21B 23/00* (2006.01)

(52) U.S. Cl.
USPC ..... 166/376; 166/214

(58) Field of Classification Search
USPC ..... 166/376, 381, 317, 214
See application file for complete search history.

(56) References Cited

U.S. PATENT DOCUMENTS

| | | | | |
|---|---|---|---|---|
| 6,349,766 | B1 * | 2/2002 | Bussear et al. | 166/113 |
| 6,949,491 | B2 | 9/2005 | Cooke | |
| 7,096,947 | B2 | 8/2006 | Todd | |
| 7,171,309 | B2 | 1/2007 | Goodman | |
| 7,182,139 | B2 | 2/2007 | Rayssiguier | |
| 7,204,312 | B2 | 4/2007 | Roddy | |
| 7,237,610 | B1 | 7/2007 | Saini | |
| 7,322,412 | B2 * | 1/2008 | Badalamenti et al. | 166/285 |
| 8,211,247 | B2 * | 7/2012 | Marya et al. | 148/400 |
| 2005/0274522 | A1 * | 12/2005 | Surjaatmadja et al. | 166/308.1 |
| 2006/0042798 | A1 | 3/2006 | Badalamenti | |
| 2007/0125532 | A1 * | 6/2007 | Murray et al. | 166/179 |
| 2008/0099209 | A1 * | 5/2008 | Loretz et al. | 166/376 |

FOREIGN PATENT DOCUMENTS

| | | |
|---|---|---|
| WO | 2007026317 | 3/2007 |
| WO | 2007066254 | 6/2007 |

* cited by examiner

*Primary Examiner* — David Andrews

(57) ABSTRACT

Downhole devices including degradable materials and methods of using such devices to control downhole operations are disclosed. A method for controlling a downhole operation includes providing a device that includes a degradable material downhole; and degrading the degradable material to activate the device. Activation of the device may result in a displacement or flow (actuators) that may be used to control or monitor (sensor) a downhole oilfield operation. A downhole device for use in a well penetrating a formation includes, in part or in whole, a degradable material.

11 Claims, 6 Drawing Sheets

SMART ACTUATION MATERIALS TRIGGERED BY DEGRADATION IN OILFIELD ENVIRONMENTS AND METHODS OF USE

CROSS-REFERENCE TO RELATED APPLICATIONS

This application claims, under 35 U.S.C. §119(e), the benefits of U.S. Provisional Patent Application No. 60/870,859 filed on Dec. 20, 2006. This Provisional Application is incorporated by reference in its entirety. This application is related to a co-pending application Ser. No. 11/769,230, entitled "Temporary Containments For Swellable Packer Elements," by Marya et al., filed on the same date as the present application.

FIELD OF THE APPLICATION

The invention relates to materials for downhole applications that are considered to be smart because they can be degraded with minimal intervention and/or in a controlled manner to actuate or activate a variety of responses through the displacement of a solid element or the flow of a fluid. Particularly, the invention relates to the use of such smart materials to remotely control oilfield operations and/or sense (monitor) downhole environmental changes.

BACKGROUND

In a variety of subterranean and wellbore environments, tools of all sorts are deployed for a multitude of critical applications. The tools, referred as downhole tools, may comprise subsurface safety valves, flow controllers, packers, gas lift valves, sliding sleeves as well as a great many other tools and accessories. Many of these tools have relatively complex mechanical designs in order to be controlled remotely from the surface; e.g. the rig floor via wirelines, hydraulic lines, or coil tubings.

FIG. 1 shows a conventional downhole tool controller system 10, which includes a controller 12 and a signal source 14. Signal source 14 is shown located at or near the surface, but may be placed in any convenient location in or around a well 16. In the embodiment shown, controller 12 is conveyed into well 16 by a tubing 18. The downhole portion of downhole tool controller system 10 may be conveyed by other means, such as a wireline or coiled tubing. A downhole tool 20 is shown in proximity to controller 12, but may be variously located in well 16.

Signal source 14 sends signals into well 16 for controller 12 to detect. Based on the signal received, controller 12 triggers the downhole tool 20 to perform a prescribed action. Signal source 14 may create signals as pressure sequences or in other forms, such as changes in the flow rates, weights, or stress/strain.

In the most common form, signal source 14 creates pressure signals to control the downhole tool 20 via the controller 12. When such hydraulic control is employed, the pressure pulse may be sent via dedicated hydraulic control lines. However, due to the restricted space of the wellbore, the number of control lines that can be run in a well is greatly limited.

Attempts have been made to increase the number of tools that each hydraulic control line can control by using multiplexers, electric/solenoid controlled valves or custom-designed hydraulic devices and tools that respond to sequences of pressure pulses. For example, U.S. Pat. No. 7,182,139 issued to Rayssiguier et al. discloses a method that uses predetermined pressure levels to independently actuate specific well tools such that the number of well tools independently controlled may be greater than the number of fluid control lines.

U.S. Pat. No. 7,171,309 issued to Goodman improves upon the reliability of such approaches by using autocorrelation of command sequences. In accordance with this method, repeat signals of a priori unknown or undefined shape can be correlated to themselves to reliably distinguish intentional changes from random fluctuations or other operations performed on the well.

While these methods are useful in providing sophisticated controls of downhole tools, it is desirable to have controls that do not rely on the limited number of control lines. Furthermore, in many situations, a downhole tool may only need to be actuated once and be left alone. In such situations, the control or actuation mechanism may be more conveniently imbedded in the tool itself.

SUMMARY

In one aspect, the present application relates to methods for controlling and/or sensing (monitoring) a downhole operation. A method in accordance with one embodiment includes providing a device downhole, wherein the device comprises at least one smart degradable material; and degrading the smart degradable material to activate the device. The smart degradable materials may be reactive metals and/or alloys of calcium, magnesium, or aluminum, or composites that include these metals and/or alloys in combination with non-metallic materials such as plastics, elastomers, and ceramics. The degradation of the smart degradable material in fluids (which may be referred to as "active fluids"), such as water, results in at least one response, such as a displacement for a solid object (e.g. a spring) or a flow for a fluid, that may itself be used to trigger other responses, for example the opening or closure of a device that may be electric, magnetic, electronic, acoustic, photonic, or a combination thereof. Therefore, a device and part of devices incorporating smart degradable materials may be considered as an "actuator" and, if used to convey any sort of signal for communication and information purposes, they may be used as "sensor and monitoring devices for downhole operations." The smart degradable material may also be used as restraining element for a variety of downhole tools.

In another aspect, the present invention relates to the use of these smart materials in downhole devices for applications such as penetrating a formation. A downhole device in accordance with embodiments of the invention comprises a degradable material, which may be degraded to irreversibly change the device from state "A" to state "B." The degradable materials may be partially metallic, as in cases of composites (e.g. metal-matrix composites, or epoxy-metal composites), or fully metallic as in cases of metals (e.g. calcium metal) and alloys (e.g. calcium alloys). The degradation may occur in part of the device or throughout the entire device. Such device may be any downhole devices, which may be as small as a proppant (gravel), or as large as an entire tool (e.g. perforated tubulars or liners). Thus, part of the well completion may be degradable, which may be useful when abandoning well. In this case, the degradable tubulars and liners may be activated to degrade without requiring a recovery operation.

Other aspects and advantages of the invention will be apparent from the following description and the appended claims.

DETAILED DESCRIPTION

Figure 1:
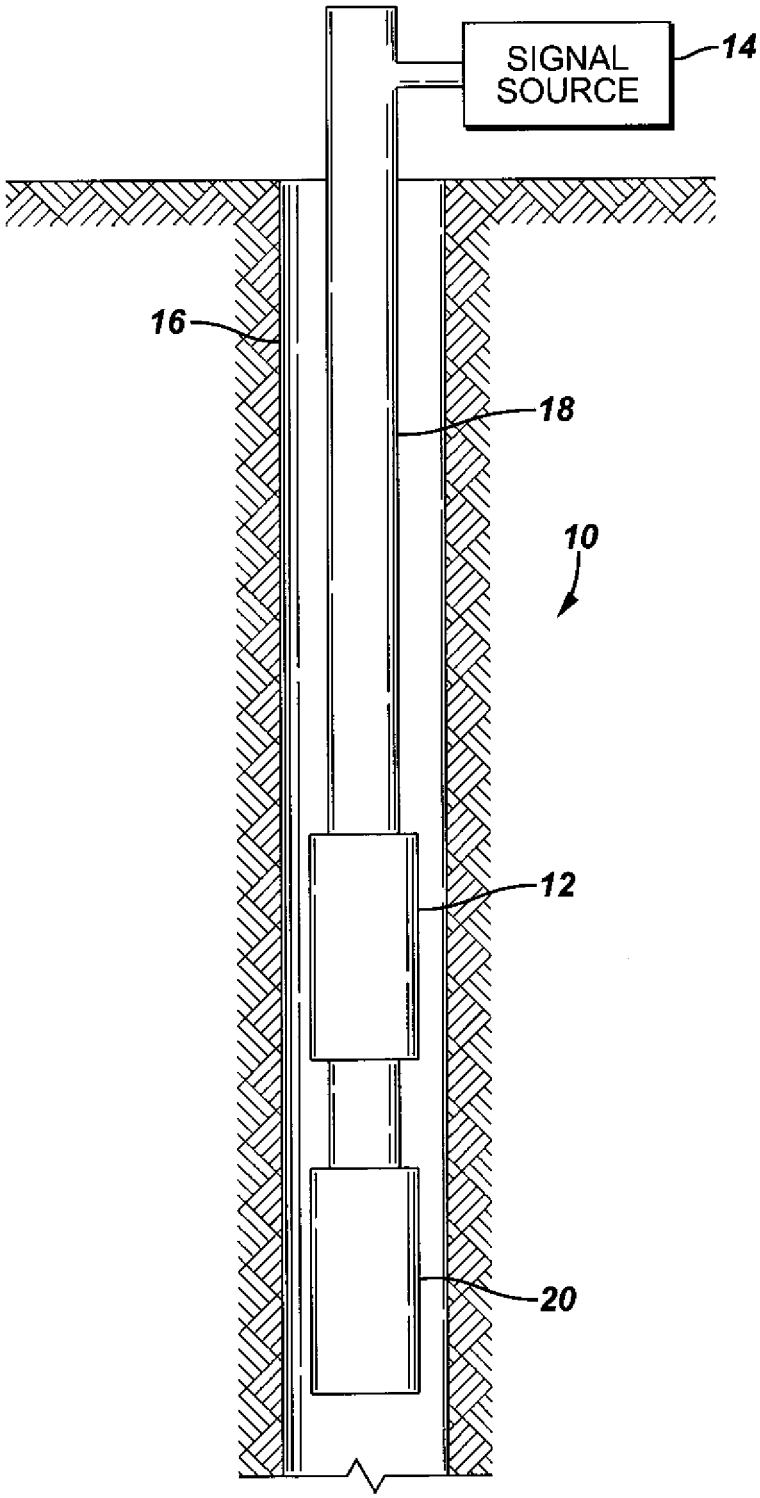
FIG. 1 (Prior Art)
FIG. 1 shows a conventional control system disposed in a wellbore.

In the following description, numerous details are set forth to provide an understanding of the present invention. However, it will be understood by those skilled in the art that the present invention may be practiced without these details and that numerous variations or modifications from the described embodiments may be possible without departing from the scope of the invention.

Embodiments of the invention relate to materials that may be characterized as smart actuation materials, because they can be degraded or converted from one state to another with minimal intervention or in a controlled manner. Furthermore, because some of these materials may also exhibit the typical, high strength of metals and alloys, their conversion from one "strong and solid" state (or phase) to a degraded state (or phase) may be accompanied by a considerable change in force, pressure, stress/pressure containment, allowing the release of strongly energized mechanism or fluid flows. Therefore, such smart degradable materials may be used in downhole tools to control and/or sense (monitor) oilfield operations. The smart degradable materials of the invention may be used to make devices that are intended for a limited term use, i.e. such devices can be degraded after the intended use without the need to retrieve them from the well through time-consuming and costly "fishing" operations. The materials of this invention may be considered "debris-free" and harmless to the well environment.

The "degradation" as used herein refers to any process that converts a smart material from a first state to a second state that is degraded. The "degradation" may be in the form of dissolution, disintegration or defragmentation, even occasionally swelling, and though not encountered, hypothetically shrinkage. Swelling refers to a volumetric expansion that is caused by a reaction between the smart material and the active fluid when the reaction product is a new material of greater volume that normally adheres to the surface of the smart material. Shrinkage would describe the opposite situation, wherein the interaction between the smart material and the active fluid is a new material of smaller volume (shrinkage is not to be confused with dissolution or mass loss in the fluid). Regardless of the form of degradation (e.g. weight losses, geometric changes), the result is a displacement, in one or several directions, that may be used to activate a variety of responses, including the release of an energized element and/or the release of a pressure thus causing a flow. These responses may be used to control and/or sense (monitor) oilfield operations. In accordance with some embodiments of this invention, the mechanical response produced by degrading the smart degradable material may itself be used to actuate other responses, for example the opening or closure of a device that may be electric, magnetic, electronic, acoustic, photonic, or a combination thereof. The fact that the degradable materials may be at least partially metallic, if not entirely metallic and therefore of relatively high strengths, opens a whole new range of possibilities for downhole oilfield operations without the need for more wireline or hydraulic controls.

Smart as used herein refers to materials that can alter their properties, including mechanical and/or rheological properties (such as shape, stiffness, and viscosity), or thermal, optical, or electromagnetic properties, in a predictable or controllable manner in response to changes in their environment (e.g. temperature, pressure/stress and composition). Common smart materials that perform sensing and actuating functions include piezoelectries, electrostrictors, magnetostrictors, and shape-memory alloys. Shape-memory alloys may be thermo-responsive alloys (i.e. alloys that can hold different shapes at various temperatures), magnetic shape memory alloys (i.e. alloys that change their shape in response to a significant variation in the magnetic field), or, less-commonly found, pH-sensitive materials, such as polymers (i.e. materials that swell/collapse when the pH of the surrounding media changes). Other smart materials are halochromic as they change their color as a result of changing acidity (pH). Others are chromogenic and hence change color in response to electrical, optical or thermal changes. Though many smart materials are reversible, smart materials do not necessarily have to be reversible, i.e., changing state (or phase) from an initial state (or phase) to the next and returning to their initial state (or phase). The materials of this invention are smart and change state (or phase) from a solid, characterized by high strengths like in metals and alloys, to a degraded state (or phase), and this change in state (or phase) may be reversible.

In accordance with embodiments of the invention, such smart (degradable) materials may be metals, alloys, or composites of metals and alloys that may include non-metallic materials, such as polymer, plastics, other organic materials (e.g. pasty fluids), or ceramics. In accordance with some embodiments of the invention, the smart materials, comprising degradable metals or alloys, may possess the strength and pressure containing capabilities needed in oilfield operations, such as when strongly energized mechanisms or significant downhole fluid pressures are needed. Due to superior mechanical properties and strength, the smart metal or alloy materials of the invention may be able to provide very rapid responses, which are not possible with typical plastics and elastomers, particularly at downhole temperatures from 200 to 450° F.

The smart materials in accordance with embodiments of the invention are selected for their ability to degrade under predetermined conditions and may be made of, for example, relatively safe and reactive metals such as calcium, magnesium, and their alloys, as well as some less reactive metals like aluminum that may be made more reactive due to alloying, processing, nanoscale structures or inoculation. The materials, when they are composites, may be partially metallic, plastic, polymeric, or others, but preferably comprise at least one degradable material that is metallic by nature. The smart materials useful to the invention are not limited to these examples, and may incorporate other materials that may have adequate mechanical strength and pressure burst or collapse resistance for the designated oilfield applications, while they can be activated or degraded in a controlled manner.

In addition, the smart materials in accordance with some embodiments of the invention may be covered with "permeable" coatings to retard the degradation, resulting in slow or delayed activation of the degradable material. Such "permeable" materials, which may be employed to retard the degradation of the smart materials, could be non-metallic; e.g. a porous or foamed rubber or plastic.

In accordance with some embodiments of the invention, a totally impermeable layer may be used to coated and protect the smart materials. Such protective coating is removed when degradation of the smart materials is desired. For example, in perforating and similar applications, the presence of perforating jets may be used to activate the degradation by damaging such protective coatings. Once the protective coating is impaired, full degradation of the smart materials may ensue, for example, by contacting with the fluids (activation fluid) in the environments. In this example, it should be noted that the perforating operation would take place whether the material is degradable or not. However, the use of degradable materials avoids the formation of fragments or other debris that might require removal by a supplementary intervention. With smart degradable materials, the removal or "fishing" of debris becomes unnecessary. In this respect, a smart degradable material may provide an additional guarantee of undisturbed well operation. In this example, the new material does not detrimentally impact the well operation; on the contrary, it reacts "smartly" to offer a new advantage.

Figure 8:
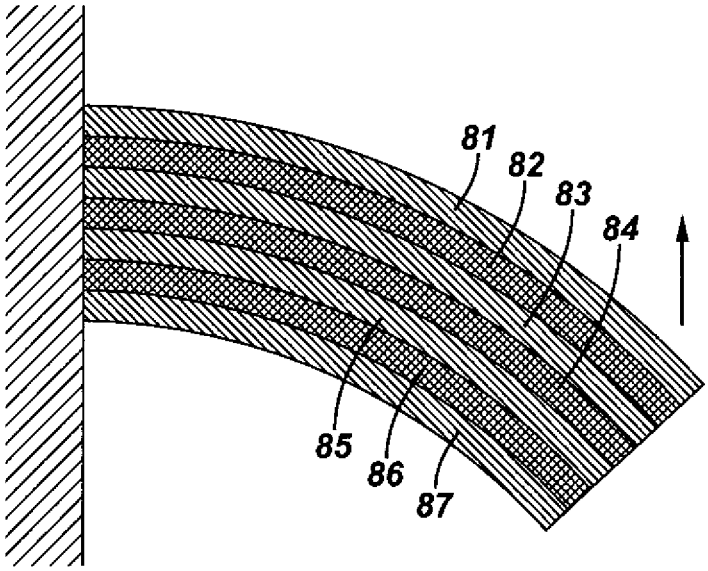
FIG. 8 shows a multiple use control in accordance with one embodiment of the invention.

In accordance with embodiments of the invention, the smart materials may be used alone or in combinations. Examples of combinational use of these materials may include a composite, in which a reactive metal, alloy or a reinforced metal or alloy is used with a temporary coating to create one or multiple layers, as illustrated in FIG. 8. The coatings may be solid and they may be made of plastics or elastomers. In some examples, the coatings may simply be made of a viscous fluid (e.g. a heavy oil) or a paste that may be washed away later during operation; they may serve to delay the activation of the degradable material.

In accordance with embodiments of the invention, the smart materials may not only be used to actuate once but to provide multiple actuations, and for instance enable a gradual change in response. For instance, the composite components of the degradable device illustrated in FIG. 8 have been designed to be used up to as many times as there are layers of degradable materials. In FIG. 8, the degradable device also illustrates a bending mode. The inventive idea of either stress-loading or conversely releasing stress from a multilayered composite incorporating degradable materials is not limited to a bending mode, and also extends to tension, compression, torsion, shear, and may include loads that in nature are mechanical, thermal, a combination of both, or other. In FIG. 8, the multilayer apparatus may be elastically loaded so as to return to an upper and horizontal position where a last layer becomes straight. As layers in the device of FIG. 8 disappears, the actuation force gradually changes (in this example reduces), thus potentially actuating a variety of tiered responses; e.g. a reduced output from a piezoelectric element conveying information to another tiered system.

In accordance with embodiments of the invention, smart materials may be induced (activated) to degrade (i.e., dissolve, disintegrate, or both) by various mechanisms, including contact with an activation or active fluid (i.e. by nature corrosive to the material) and/or due to a change in temperature and/or pressure. The change in temperature and pressure may be provided by a source of thermal energy (i.e. the trigger of a temperature change) or mechanical energy (the results of an explosion or brief pressure spike for instance, as found in jet perforating).

It should be noted that the word "activate" or "activation" is used herein with reference to what is known as "activation energy" in chemical thermodynamics. A chemical reaction or phase transformation may occur over a range of conditions. Using temperature activation as an example, only when a threshold temperature is exceeded would the reaction or transformation proceed at a substantial rate or to a substantial extent, and therefore become noticeable and useful.

For examples, certain materials (e.g. calcium) of the invention degrade at extremely slow rates in neutral (pH=7) water at ambient temperature, i.e. their rates of degradation are nearly zero. As the temperature is raised (e.g., in a downhole wellbore, the temperature may be allowed to increase by equilibrating with its surrounding, as found in the absence of a cold pumped fluid from the surface), the same materials may dissolve with a rate several orders of magnitude greater than at ambient (surface) temperature. In this case, the reaction or transformation exists at both low and high temperatures. However, the reaction or transformation only becomes valuable (or usable) at a relatively high temperature (e.g., downhole temperature) where the reaction or transformation rate is significant. The materials undergoing a fast transformation (i.e. degradation) is then said to be activated. Such materials may be referred to as smart materials because they react in response to changes in its surrounding environment and with minimal intervention or no additional intervention.

As noted above, the degradation of smart materials may be activated by contacts with selected active fluids, temperatures, and/or pressures. The active fluids that can be used to degrade the smart degradable materials may be solvent to the particular materials such that these materials will dissolve in the fluids. The "active fluids" may be liquid, gas, or both. The liquid-type active fluids will typically contain water, but is not so limited and may contain other liquids such as acids. The gas-type active fluids may contain any suitable gases, including as non-Limiting examples water vapor and acid vapors. Furthermore, some active fluids may be multi-phase fluids, which, for example, may have water as one constituent. Some water-based active fluids may also be comprised of an acid or a brine (e.g. some chlorides) dissolved in water, and may contain dissolved gases, such as carbon dioxide ($CO_2$) or hydrogen sulfide ($H_2S$), that contribute to enhancing acidity of the active fluid and, therefore, raise degradation rates.

In addition to active fluids, degradation of the smart materials may also be triggered by the temperature or pressure, which may be transient (e.g., short) or sustained (e.g., prolonged). An example of a transient pressure is the pressure momentarily caused by a perforating jet of an explosion, a high-velocity abrasive fluid jet, or the impact of one object onto another.

As noted above, in accordance with some embodiments of the invention, the smart materials include metals or alloys. Typical examples of smart metals and alloys in accordance with embodiments of the invention include relatively safe alkaline & alkaline-earth metals such as calcium (Ca safely dissolves in water regardless of pH), magnesium (Mg dissolves at low pH), aluminum (Al dissolves at low pH), and alloys and composites of those metals that degrade in water at rates that depend upon temperature, pressure, and fluid composition. For example, acids may accelerate the degradation of these metals or alloys.

The following Table lists some examples of metal and alloy smart materials in accordance with embodiments of the invention. The Table lists metal and alloy compositions, degradation rates at normal pressure (1 atm) in water of specific pH and temperature, as well as their approximate ambient-temperature strength. As shown in this Table, an alloy of calcium containing 20 percent by weight magnesium degrades much slower than pure calcium metal (i.e., 99.99% Ca) and is also about 10 times stronger (i.e., its strength is comparable that of quenched and tempered steels). In addition, note that aluminum can be made degradable in neutral water with suitable alloying elements.

| Material | Strength (MPa) | Temperature (° C.) | pH range | Degradation rate (mm/h) |
|---|---|---|---|---|
| Calcium metal | ~70 | 25 | 3-11 | ~5 |
| (99.99% Ca) | | 65 | 3-11 | 10-11 |
| | | 90 | 3-11 | 17-20 |
| Calcium alloy | ~700 | 25 | 3-11 | ~0.05 |
| (Ca—20 wt. % Mg) | | 65 | 3-11 | 0.2-0.3 |
| | | 90 | 3-11 | 1.2-1.7 |
| Aluminum metal | ~100 | 90 | 7 | <0.0001 |
| (99.99Ca) | | | | |
| Aluminum alloy | ~ | 90 | 7 | ~0.17 |
| (Al—21Ga) | | | | |
| Aluminum alloy | ~ | 90 | 7 | ~0.03 |
| (Al—10Ga—10Mg) | | | | |
| Aluminum alloy | ~ | 25 | 7 | 0.5-0.6 |
| (Al—5Ga—5Mg—5In) | | 90 | 7 | 0.8-0.9 |

A convenient method to activate (degrade) these smart materials is to make use of the temperature change that, are typically encountered in a wellbore. As shown in the Table above, the slow, and perhaps unnoticeable, degradation rates may be enhanced by increasing temperatures. This is exemplified by the calcium alloy, the degradation rate of which is increased over 20 times by raising the temperatures from 25 to 90° C. Thus, the same reaction at a temperature of 200° C. or higher (which is likely encountered in a deep wells) may become sufficiently fast to degrade these materials (and components made at least partially of those materials) within predictable durations.

In accordance with embodiments of the invention, these smart materials may be used to make smart devices for various controls, such as downhole tool controls. These devices are designed to change from state A to state B upon degradation of the smart materials from one state or phase to the following degraded state or phase. An example of changing a device from state A to state B may be found in a valve that is turned "on" from an "off" state.

The use of smart materials to make smart devices would allow an operator to control the devices with limited or no external direct intervention and without control lines. All the operator needs to do is to initiate the smart material degradation process, for example, by increasing pressure (e.g., by increasing a set-down weight), and/or by addition of a degradation reagent (e.g., an acid or a brine that would accelerate the rates of degradation). Upon degradation of the smart materials, a change in the force, displacement, or the like (pressure and stress, or strain) would occur within the smart device. This in turn will result in the actuation of the device.

The smart materials in accordance with embodiments of the invention may be used in various oilfield applications. The following describe several examples pertinent to downhole oil and gas recovery operations. However, one of ordinary skill in the art would appreciate that these examples are for illustration only and various variations and modifications are possible without departing from the scope of the invention.

For example, embodiments of the present invention may be used in the control of flow and displacement in downhole environments. The smart materials may be used in actuators, for example, to activate other mechanisms, which may be as simple as compression springs (as used in, for example, energized packer elements or production packer slips, anchoring release devices, etc) or more complex systems (such as a variety of electronic gauges and sensors). In accordance with some embodiments of the invention, the material may itself be used as a sensor. The disappearance or compromise of integrity (e.g., due to degradation) of the smart materials could indicate the presence of a particular condition, for example, water (liquid and/or vapor) in situations where water (liquid and/or vapor) would not be expected in the well environment or in situations where the production of water would indicate the oil reservoir has been depleted, and it may be time to abandon the well.

FIG. 2 shows a schematic illustrating how a smart material of the invention may function to control a device or a flow. As shown in FIG. 2A, the presence of the smart material (or degradable material) blocks the action of a force or pressure (e.g., hydraulic or mechanical force) acting on a system (e.g., a valve). FIG. 2B shows one example in which the presence of a smart material prevents fluid flow (e.g., by keeping a valve in a closed position), while FIG. 2C shows that fluid flow is possible after the smart material has been degraded. In another example, FIG. 2D shows that the presence of the smart material prevents a spring from being extended. Once the smart material is degraded, as shown in FIG. 2E, the spring extends, therefore releasing its stored elastic energy, and the force exerted by the spring may be used to cause a displacement of some parts in a device—e.g., to slide open a sleeve valve. Though FIG. 2 illustrates an example with a compression spring, the same concept of releasing energy through the degradation of a material loading a spring may also be used with other loading modes. Such modes include tension, torsion, shear and/or bending, and the element storing mechanical energy is not only limited to mechanical springs, but broadly includes any materials that is elastically or reversibly loaded; e.g. a beam placed in a bending mode.

Figure 2A:
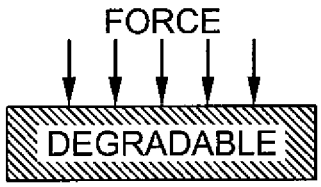
FIG. 2 shows a schematic illustrating the use of a smart degradable material in the control of an action in accordance with embodiments of the invention.
Figure 2B:
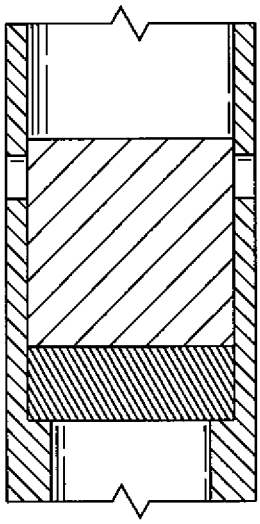
Figure 2C:
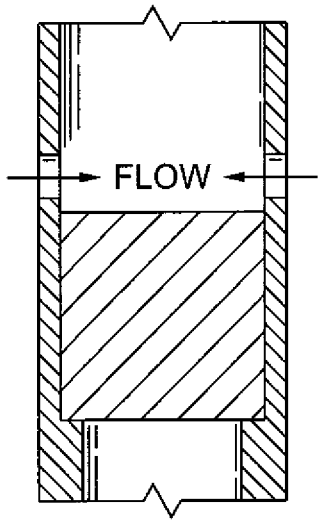
Figure 2D:
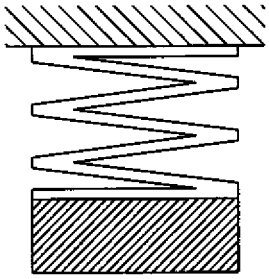
Figure 2E:
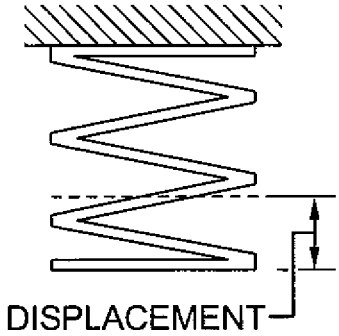
Figure 3:
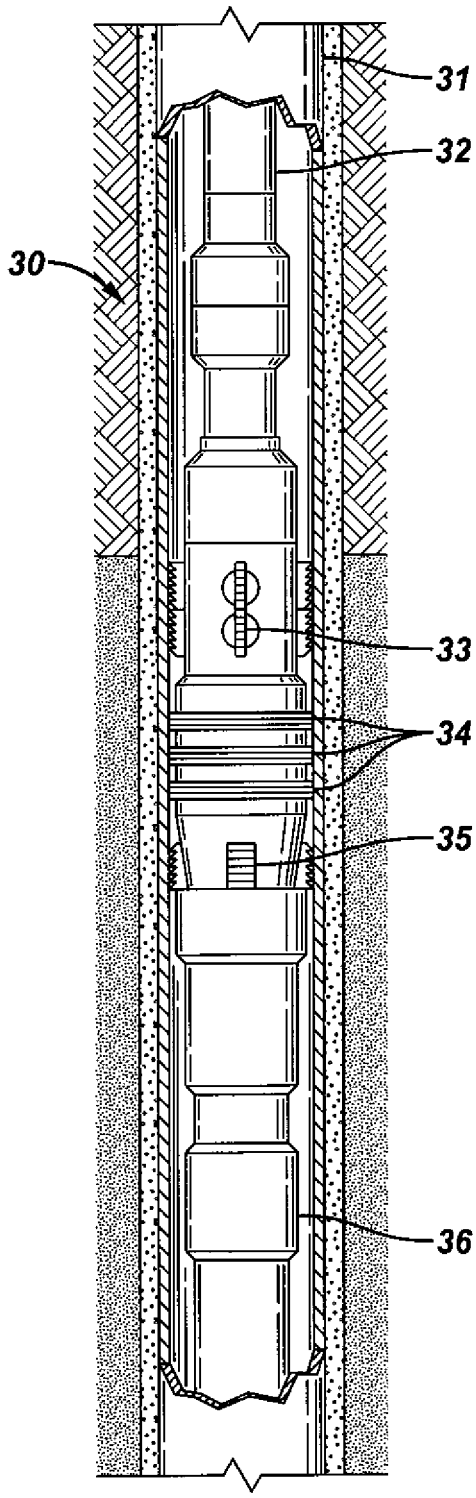
FIG. 3 shows a production system disposed in a producing well.

FIG. 3 shows an oil production system 30 disposed in a wellbore. As shown, a production tubing 32 is disposed in a production casing or liner 31. The production tubing 32 includes several devices: hold-down slips 33, packer elements 34, set-down slips 35, and tail pipe and lower completion components 36. Once the production tubing 32 is in place, the packer elements 34 may need to be set. To set a packer, some downhole device is activated. The activation mechanism may be as shown in FIG. 2.

Figure 4:
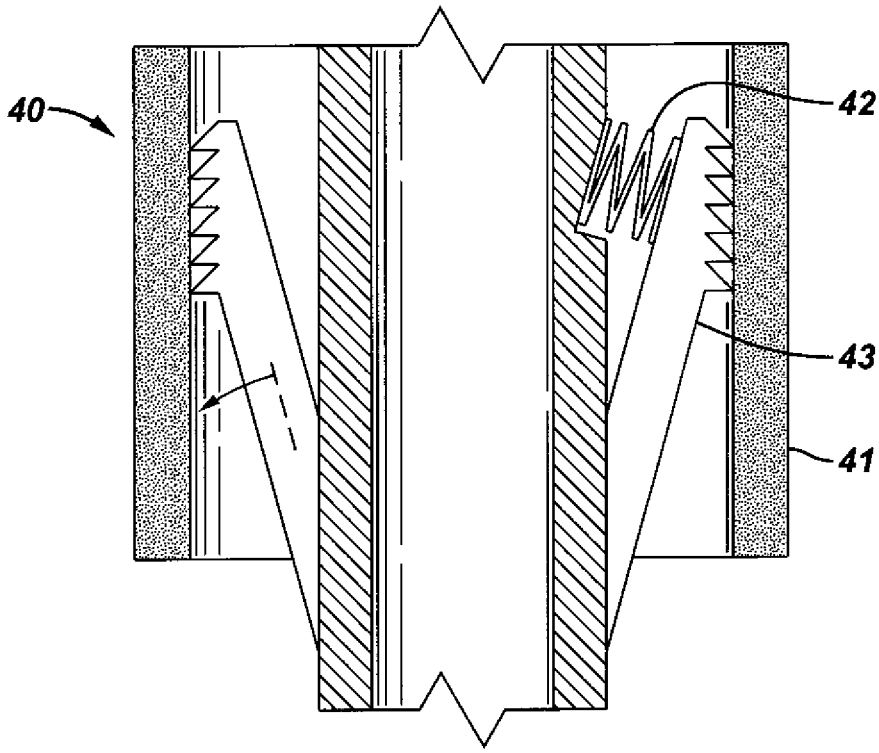
FIG. 4 shows a control device using a spring and a smart degradable material in accordance with one embodiment of the invention.

FIG. 4 shows one example of an actuation mechanism 40 that uses a spring loaded mechanism, as illustrated in FIG. 2D and FIG. 2E. As shown in FIG. 4, a pivotal arm 43 is designed to engage the wellbore wall by the action of the spring 42. A device of a degradable material (smart material) 41 of the invention may be used to prevent the deployment of the pivotal arm 43 until it is time for deployment. When it is time to deploy the pivotal arm 43, the degradable material is degraded to allow the displacement of the spring 42. The force from the spring 42 will then urge the pivotal arm 43 to engage the borehole wall. The release of the pivotal arm is expected to find applications in the deployment of packer slips, or any expandable tools that need to be temporarily restrained. The degradable device 41 in FIG. 4 may be in the form of a tubular, but may take any shape provided that it fulfills the basic functions of preventing displacement and/or flow and reacts "smartly" to its environment.

Figure 5:
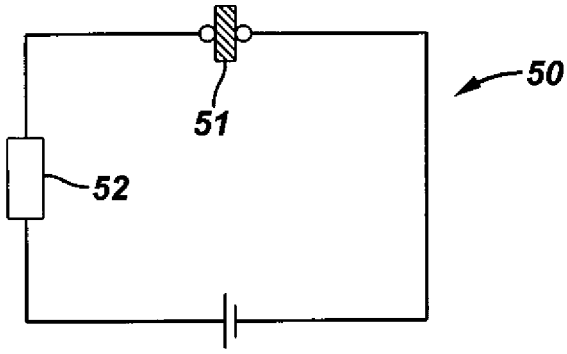
FIG. 5 shows a schematic illustrating a sensor comprising a smart degradable material in accordance with one embodiment of the invention.

In accordance with some embodiments of the invention, smart materials may be used in sensors, which may be used to detect the presence of a corrosive fluid (water liquid, water vapor, etc). For example, FIG. 5 shows an electrically conductive, high-strength water-soluble smart material 51 is used to "close" a circuitry 50 of a sensor. If water is encountered by this device, the smart material will degrade, displace the active fluid (in this example) and the presence of water or other active fluid, by increasing electrical resistance (impedance) would stop the current to flow in the circuitry and therefore activate a signal generator 52. Activation of the signal generator 52 may produce a system response, which may commonly be mechanical (spring or any other displacement, or a fluid flow, as shown in FIG. 2), electrical, electronic, magnetic, acoustic, photonic, or a combination thereof. Again, this example of electrical switch depicted in FIG. 5 is made possible because of the removal of an electrically conductive degradable materials and the displacement it caused by introducing a non-conductive, or poorly conductive medium. A situation opposite to that just describe (i.e., a non-conductive material degraded by a conductive liquid) would also work.

Figure 6:
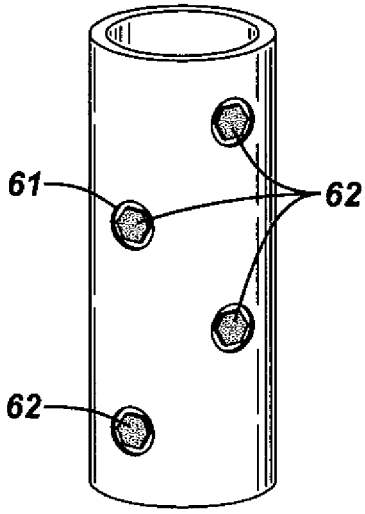
FIG. 6 shows a downhole tubing or casing having holes temporarily plugged by degradable plugs in accordance with one embodiment of the invention.

In accordance with some embodiments of the invention, the smart materials may be used with hollow components (such as liners or casing), in which the smart materials are used as degradable plugs/caps/sealing elements. FIG. 6 shows one example of a casing having a plurality of holes 61, in which degradable plugs 62 temporarily seals these hole. In one example, the smart degradable plugs may be selected according to the downhole environments, to which they will be exposed, such that the smart degradable plugs slowly disappear over time. In other examples, a protective coating may be applied on the plugs, wherein the protective coating may be compromised by an impact (such as by the side impact of a fallen object), an abrasive or an explosive jet, for instance. For example, when jet perforation is to be performed, these holes 61 may be opened by degrading the temporary plugs 62. Degradable plugs may be also useful to prevent flow though slotted liners, where pre-drilled or pre-cut holes are encountered. A liner may also look like the tubing of FIG. 6.

In accordance with some embodiments of the invention, the smart materials may be used in disposable and degradable tools, such as shaped charges and perforating guns, including tools used in tubing-conveyed applications. These devices will eventually degrade in the well or formation, saving the need to retrieve these devices after use. These devices may be considered zero-debris devices and may include perforating shaped charge casings, guns, and related devices. Such degradable devices would simplify oilfield operations by eliminating the need for recovery or fishing operations.

In accordance with some embodiments of the invention, the smart materials may be selected to be crush resistant for use in a fracturing fluid. These types of materials, for example, may include metals or alloy (e.g., calcium alloy, aluminum alloy), and composites of those. Such materials may be used as additives or proppants in a hydraulic fracturing fluid. Such materials may be in the shape of flakes, shots, granules and the like. Such materials can be placed in the formation fractures to momentarily increase flows. When production from that particular zone is no longer needed, these materials may be degraded to close the fractures, for instance by pumping an active fluid (e.g. an acid), and/or stopping pumping a cold fluid, and/or enabling the naturally hot reservoir temperature to return to equilibrium.

Figure 7A:
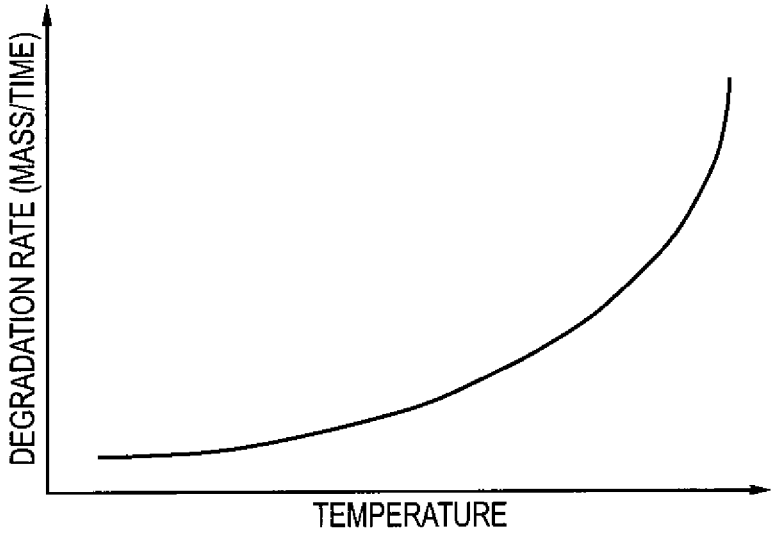
FIG. 7A and FIG. 7B show charts illustrating how temperature and pH may be used to control degradation of a smart material in accordance with one embodiment of the invention.
Figure 7B:
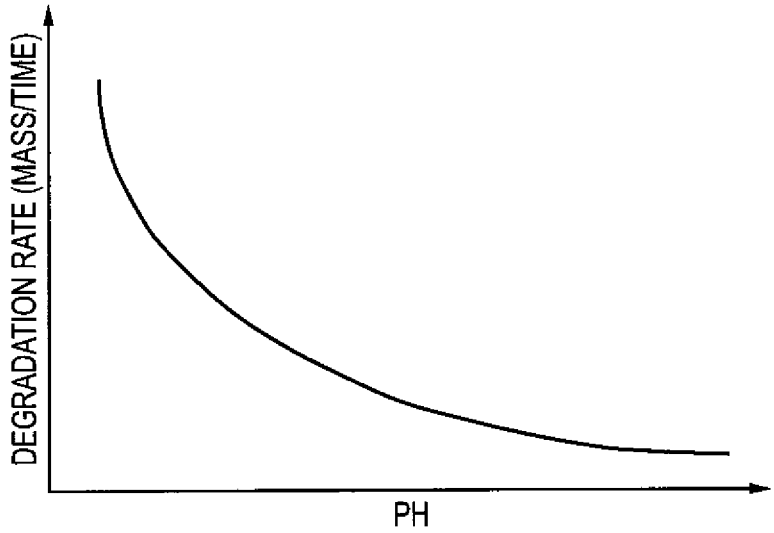

As noted above, degradation of the smart materials may be by contacting selected fluids, temperatures, and/or pressures. In addition, the pH of the fluids may also be changed to degrade the smart materials in cases such material degradation rate is affected by pH, which had been seen in laboratory experiments with aluminum and magnesium alloys. With temperature and/or pressure, the materials may be so selected that the changes in temperatures and/or pressure (i.e., in typical downhole applications) would raise their degradation rates. FIGS. 7A and 7B show two charts illustrating how degradation rates (i.e., the activation of the smart materials) may be controlled by temperature (FIG. 7A) and pH (FIG. 7B). FIG. 7A shows that the smart material degradation increases exponentially with the temperature, typically following an Arrhenius-type law; i.e. the degradation is thermally activated. FIG. 7B shows that low pH values (as produced by concentrated acids in water) also increase degradation rates. An increase in degradation may also be induced by greater pressures. For example, the pressure of deep wells may increase degradation rate more than the relatively low pressures of shallow wells.

The degradable materials are best suited for one-time use; however, they are not so limited. In accordance with some embodiments of the invention, certain degradable materials may function as smart actuators on a repeatable (multiple use) basis. For such multiple uses, more complex materials such as laminated or layered composites may be designed. In a laminated or layered composite, the number of layer may indicate the number of times the component can be used. Such composites may be designed to release elastic energy, or residual stresses as part of the composite degrades.

FIG. 8 shows a simple example to illustrate the principle of operation of such composite materials (for illustration purpose). In FIG. 8, the light gray layers 81, 83, 85, 87 are protective layers and the dark gray layers 82, 84, 86 represent the degradable material. Note that the layered materials or composites of FIG. 8 are made of repetitive layers. In FIG. 8, the composite layers are loaded in a bending conformation. This is for illustration only (other loading conditions are possible). The composite of FIG. 8 is comprised of two materials. However, in real situations, these composites may be more complex and may comprise a variety of shapes and different materials to serve under various loading conditions.

In the simple mechanism of FIG. 8, the deflection is gradually relieved as layers of the dark gray (degradable) materials are removed. Such changes in deflection may be used as activation devices, for instance a sensor having more than simple ON and OFF positions, but having a set of intermediate positions corresponding to the gradual release in deflection. The light gray layers are to delay the degradation of the dark gray layers and may be made of materials slowly absorbing the fluid of the surrounding environment (e.g. elastomers, plastics, porous ceramics, etc).

Figure 9:
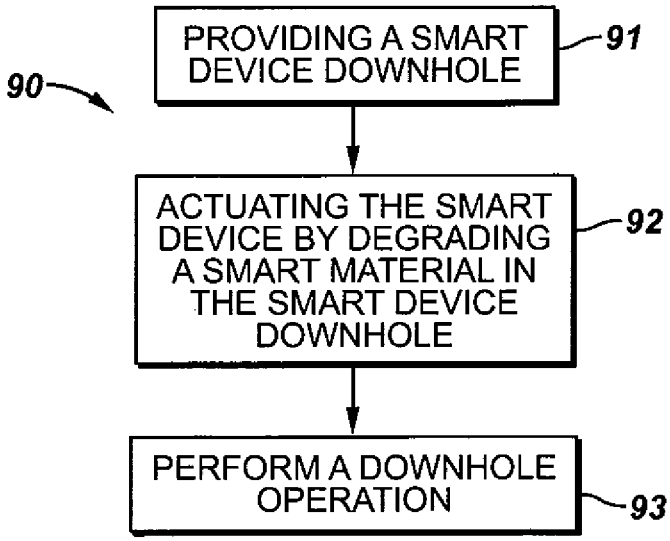
FIG. 9 shows a flow chart illustrating a method in accordance with one embodiment of the invention.

FIG. 9 shows a flow chart illustrating a method 90 for controlling a downhole operation in accordance with one embodiment of the invention. As shown in FIG. 9, a smart device is provided downhole (step 91). The smart device comprises a smart material of the invention. When a particular action is desired, the smart device is activated by degrading the smart material in the smart device (step 92). As a result of the activation, a downhole operation is performed (or stopped) (step 93).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for controlling a downhole operation, comprising:

conveying a device into a borehole, wherein the device comprises an actuator comprising:

an outer layer comprising an elastomer, a plastic, or a porous ceramic; and an inner layer comprising at least one degradable material comprising:

a calcium alloy comprising about 80 wt % calcium and about 20 wt % magnesium;

an aluminum alloy comprising about 80 wt % aluminum, about 10 wt % gallium, and about 10 wt % magnesium; or an aluminum alloy comprising about 85 wt % aluminum, about 5 wt % gallium, about 5 wt % magnesium, and about 5 wt % indium; and degrading the degradable material to actuate the device, wherein the outer layer controls the rate at which the degradable material degrades.

2. The method of claim 1, wherein the degrading of the degradable material results in a displacement of at least one selected from the following: a solid object and a flow of a fluid.

3. The method of claim 1, wherein the degrading of the degradable material comprises contacting the degradable material with a fluid.

4. The method of claim 3, wherein the fluid is at least one selected from the following: liquid, gaseous, and multi-phase.

5. The method of claim 3, wherein the fluid is one selected from the group consisting of water, seawater, an acid, brine, and a combination thereof.

6. The method of claim 1, wherein the degrading is initiated by changing at least one of the following: temperature, pressure, fluid composition, and a combination thereof.

7. The method of claim 1, wherein the device is part of a downhole tool.

8. A downhole device for use in a well penetrating a formation, wherein the downhole device comprises an actuator comprising:

an outer layer comprising an elastomer, a plastic, or a porous ceramic; and an inner layer comprising at least one degradable material comprising:

a calcium alloy comprising about 80 wt % calcium and about 20 wt % magnesium;

an aluminum alloy comprising about 80 wt % aluminum, about 10 wt % gallium, and about 10 wt % magnesium; or an aluminum alloy comprising about 85 wt % aluminum, about 5 wt % gallium, about 5 wt % magnesium, and about 5 wt % indium.

9. The downhole device of claim 8, wherein the device further comprises:

a pivotable arm disposed about a body, the pivotable arm having a first end and a second end, wherein the first end of the pivotable arm is adapted to pivot about a point disposed on an outer surface of the body;

a spring disposed between the second end of the pivotable arm and the body; and the actuation device at least partially disposed about the pivotable arm and the body so that the spring is compressed.

10. A method for controlling a downhole operation, comprising:

locating a degradable component in a wellbore, the degradable component comprising:

a pivotable arm disposed about a body, the pivotable arm having a first end and a second end, wherein the first end of the pivotable arm is adapted to pivot about a point disposed on an outer surface of the body;

a spring disposed between the second end of the pivotable arm and the body; and an actuator at least partially disposed about the pivotable arm and the body so that the spring is compressed in a run-in position, the actuator comprising:

an outer layer comprising an elastomer, a plastic, or a porous ceramic; and an inner layer comprising at least one degradable material comprising a calcium alloy comprising about 80 w % calcium and about 20 w % magnesium; an aluminum alloy comprising about 80 w % aluminum, about 10 w % gallium, and about 10 w % magnesium; or an aluminum alloy comprising about 85 w % aluminum, about 5 w % gallium, about 5 w % magnesium, and about 5 w % indium; and at least partially degrading the degradable material to release the spring and allow the arm to pivot away from the body to actuate the device, wherein the outer layer comprises the rate at which the degradable material degrades.

11. The method of claim 10, wherein the degradable member is tubular and fully encases the pivotable arm and the body.

* * * * *